US005613316A

United States Patent [19]

Hightower

[11] Patent Number: 5,613,316

[45] Date of Patent: Mar. 25, 1997

[54] SHOTGUN MAGAZINE SLING ATTACHING DEVICE

[76] Inventor: Floyd L. Hightower, 5617 Lake Highlands Dr., Waco, Tex. 76710

[21] Appl. No.: 399,936

[22] Filed: Mar. 6, 1995

[51] Int. Cl.[6] ..... F41C 27/00

[52] U.S. Cl. ..... 42/85; 224/150

[58] Field of Search ..... 42/85, 49.01, 49.02; 224/150, 913; 220/298, 301, 302

[56] References Cited

U.S. PATENT DOCUMENTS

| | | | |
|---|---|---|---|
| 1,068,060 | 7/1913 | Johnson | 42/49.01 |
| 2,620,581 | 12/1952 | Fiorini | 42/49.01 |
| 2,884,172 | 4/1959 | Kubo | 224/913 |
| 3,633,944 | 11/1970 | Hamburg | 285/81 |
| 3,715,827 | 5/1971 | McKinzie . | |
| 3,814,288 | 6/1974 | Westrich . | |
| 4,087,930 | 5/1978 | Grehl | 42/49.01 |
| 4,310,982 | 1/1982 | Kast et al. | 42/49.01 |
| 4,502,238 | 3/1985 | Farrar et al. | 42/72 |
| 4,542,840 | 9/1985 | Pepper, Sr. et al. . | |
| 4,685,237 | 8/1987 | Hugg | 42/85 |
| 4,691,852 | 9/1987 | Phelps . | |
| 4,736,540 | 4/1988 | Holmes | 42/90 |
| 4,819,844 | 4/1989 | Neimela . | |
| 4,912,868 | 4/1990 | Thompson | 42/77 |
| 5,092,071 | 3/1992 | Moore . | |
| 5,110,003 | 5/1992 | MacWilliams | 220/304 |
| 5,303,859 | 4/1994 | Jenkin . | |

FOREIGN PATENT DOCUMENTS

| | | | |
|---|---|---|---|
| 604301 | 5/1960 | Italy | 42/49.01 |

*Primary Examiner*—Michael J. Carone
*Assistant Examiner*—Christopher K. Montgomery
*Attorney, Agent, or Firm*—Diller, Ramik & Wight, PC

[57] ABSTRACT

A shotgun sling attaching device is provided for attaching a sling to a shotgun magazine tube. The attaching device includes a cap-like member defined by an end panel having an opening, a peripheral skirt and a flange with an inner surface of the end panel and the flange being provided with locking means that cooperate with various types of conventional detent locking systems of shotguns. A swivel is united to the end panel and rotates 360° relative to the cap-like member. A bore through the swivel attached a swivel loop of the sling thereto.

1 Claim, 1 Drawing Sheet

FIG. 1
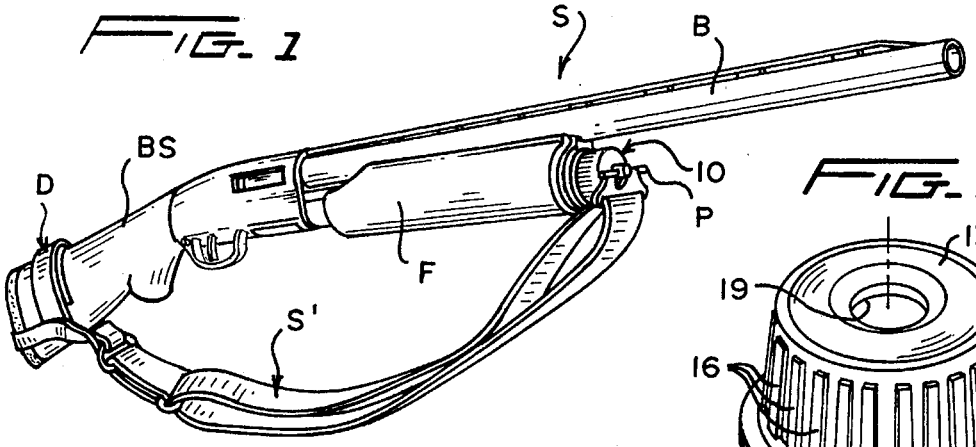
FIG. 3
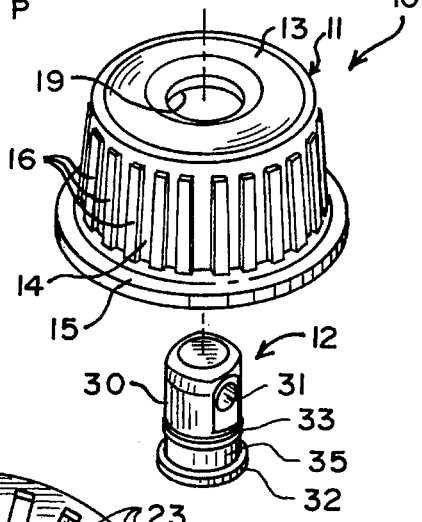
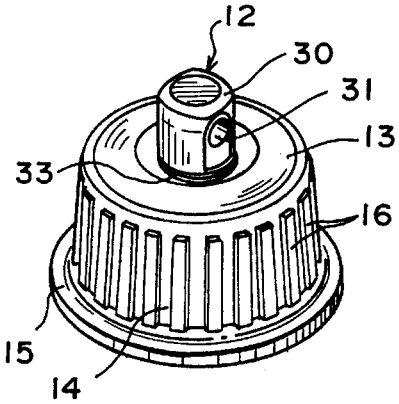
FIG. 2
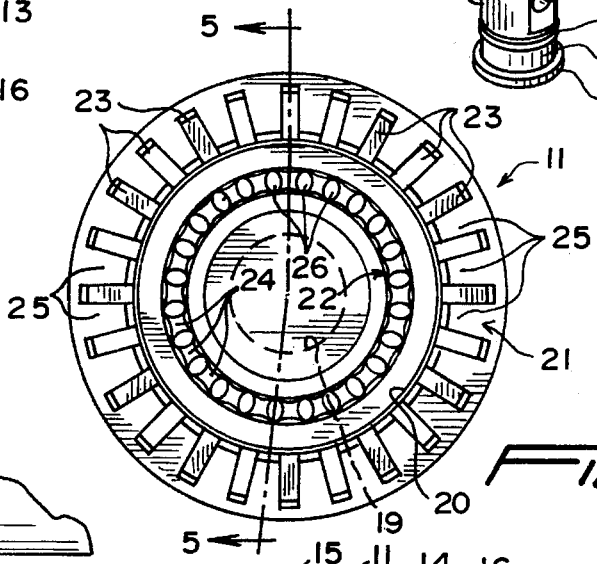
FIG. 4
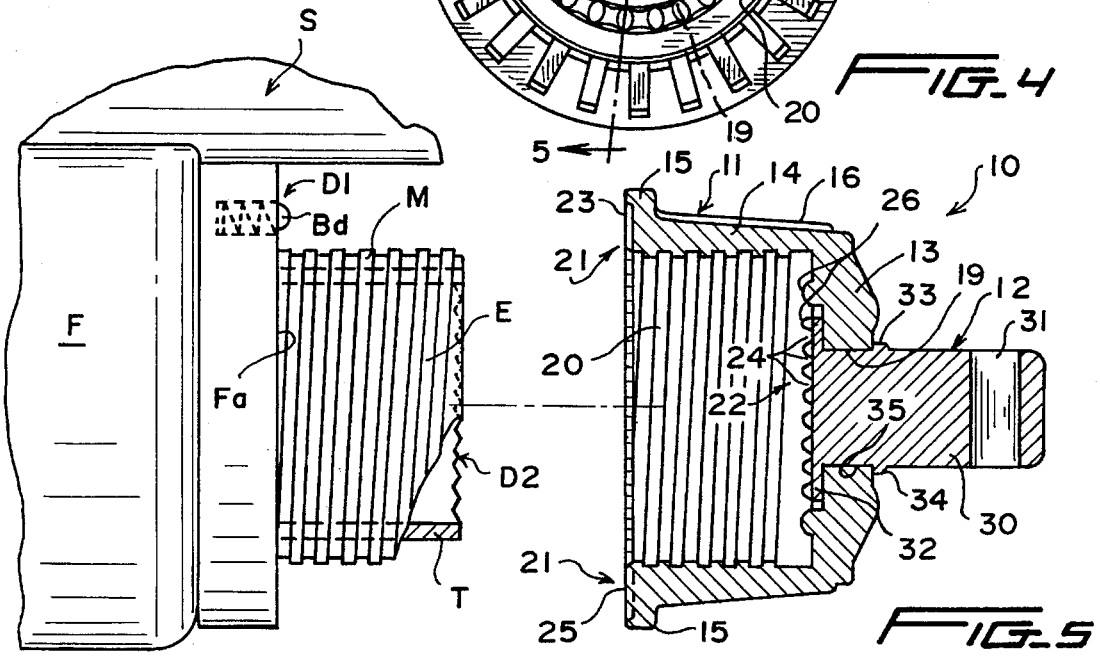
FIG. 5

SHOTGUN MAGAZINE SLING ATTACHING DEVICE

BACKGROUND OF THE INVENTION

This invention is directed to an attaching device for attaching a sling to a shotgun, rifle or the like, and particularly to attaching a sling to a tubular shotgun magazine. Typical of a patent dealing with the concept of securing a shotgun sling to a shotgun magazine tube can be found in U.S. Pat. No. 5,303,859 issued to Jenkin which is considered to be the most pertinent of several patents selected during a search of the instant subject matter. The magazine tube terminates in a threaded end portion which extends beyond the forestock or stock member. Two rings are slipped over the threaded end portion and are held in position by an internally threaded cap. One ring has a bore which receives a forward sling member or loop of the shotgun sling. Accordingly, this patent discloses the broad concept of utilizing a connector between a shotgun magazine end portion and an associated sling. Other patents uncovered during the search include U.S. Pat. Nos. 5,092,071; 3,715,827; 3,814,288; 4,542,840; 4,691,852 and 4,819,844 issued respectively to Moore, McKinzie, Westrich, Pepper, Sr. et al., Phelps and Niemela.

SUMMARY OF THE INVENTION

In keeping with the foregoing, a primary object of the present invention is to provide a novel magazine sling attaching device for securing a sling to a shotgun, rifle or the like which is relatively inexpensive to manufacture, can be readily secured to an associated magazine tube, and when so secured securement is reliable yet the sling attaching device can be readily and quickly removed from the magazine tube. The magazine tube sling attaching device of the present invention provides the foregoing advantages through a unique construction in which a cap-like member is provided with internal threads to secure the cap-like member to the external threads of the magazine tube and carries a rotatable pin having a transverse bore to which can be attached a conventional sling swivel, loop, or the like. The cap-like member is designed to fit several models of conventional shotguns and thus has universal application, and in each application the cap-like member is provided with a series of lands/peaks and valleys which selectively cooperate with either of a spring biased detent locking system or a "geared" or ratcheted detent locking system of conventional shotguns which cooperate with conventional magazine tube caps to secure the latter to the magazine tube. These conventional detent locking systems prevent the conventional magazine cap from bottoming against the magazine tube and also prevent inadvertent unthreading of the cap therefrom. In a similar manner the cap-like member of the invention can readily, efficiently and effectively secure a sling to a variety of different shotguns, and specifically to the shell magazine or shotgun shell magazine tube thereof absent inadvertent or accidental removal.

With the above and other objects in view that will hereinafter appear, the nature of the invention will be more clearly understood by reference to the following detailed description, the appended claims and the several views illustrated in the drawings.

BRIEF DESCRIPTION OF THE DRAWINGS

FIG. 1 is a perspective view, and illustrates a shotgun to which a sling is attached at one end by a magazine sling attaching device of the present invention.

FIG. 2 is a perspective view of the magazine sling attaching device of the present invention, and illustrates a cap-like member having an apertured end panel through which projects a swivel or pin having a bore therethrough.

FIG. 3 is an exploded perspective view, and illustrates the swivel or pin separated from the cap-like member.

FIG. 4 is a bottom plan view of the assembled cap-like member and swivel, and illustrates a coaxial pair of lands and valleys carried by an outwardly directed peripheral flange and an end panel of the cap-like member for engaging spring biased ball detent and geared/ratchet detent locking systems of conventional shotguns.

FIG. 5 is a an exploded cross sectional view taken generally along line 5—5 of FIG. 4, and illustrates the cross sectional configuration of the cap-like member in axial aligned relationship to an end of a shotgun shell magazine or magazine tube of a shotgun.

DESCRIPTION OF THE PREFERRED EMBODIMENT

A shotgun S is illustrated in FIG. 1 of the drawings, and includes a barrel B, a forestock F and a butt stock BS. A conventional sling S' is secured to a butt stock sling attaching device D which is disclosed in a U.S. application for patent, filed on even date herewith under Ser. No. 08/387,401, now U.S. Pat. No. 5,575,411, in the name of Floyd Hightower.

An opposite end of the sling S' is secured by a magazine sling attaching device 10 of the invention to an externally threaded end portion E (FIG. 5) of a shotgun shell magazine or magazine tube M projecting beyond a front face Fa of the shotgun forestock F.

Normally the magazine tube M is closed by a conventional magazine cap which simply includes an end panel, a peripheral skirt, and internal threads carried by the peripheral skirt which mate with and engage the threaded end portion E of the magazine tube M. Depending upon the particular shotgun S, such a conventional cap is locked in position by one of two different detent locking systems, both of which are illustrated in FIG. 5.

One detent system is generally designated by the reference numeral D1 and includes a cylindrical bore (unnumbered) formed in the forestock F which houses a capsule (unnumbered) confining a spring (unnumbered) which normally biases a ball or ball detent Bd outwardly beyond the face Fa of the forestock F.

The other detent locking system is generally designated by the reference character D2 and includes a tube T having a peripheral face provided with "geared" or ratchet detents comprised of lands/peaks and valleys. The detent tube T is normally biased outwardly to the right beyond the end face (unnumbered) of the magazine tube M by a spring (not shown) and the geared detents D2 engage against an end panel of an associated conventional magazine tube cap.

The detent locking system D1 is typical of the detent locking system utilized on Remington's Model 1100 autoloading shotgun and on Remington's early Model 870. The detent locking system D1 can also be located on a cylindrical sleeve (not shown) carried by the shotgun barrel at its forward end beneath and rearward of the forward sight. The detent locking system D2 is found on Remington's late Model 870 and Model 11-87 autoloading shotguns.

The magazine sling attaching device 10 is of a two piece construction, as is best illustrated in FIGS. 3 and 5 and is generally defined by a cap-like member 11 and a swivel, swivel means or pin 12 which are each preferably injection molded from relatively strong polymeric/copolymeric plastic material, such as nylon.

The cap or cap-like member 11 includes an end panel 13 having a circular opening 19 and depending from the end panel 13 is a peripheral skirt 14 terminating in an outwardly directed peripheral flange 15. The peripheral skirt 14 carries a plurality of generally axially extending parallel ridges 16 which facilitate nonslip gripping of the cap-like member 11. The cap-like member 11 of the magazine sling attaching device 10 includes internal threads 20 which correspond to the external threaded portion or threads E of the shotgun magazine tube M to threadably attach and detach the cap-like member 11 relative to the magazine tube threaded end portion E in a conventional manner apparent from FIG. 5.

When the cap-like member 11 is threaded upon the threaded end portion E of the magazine tube M, it is desirable to prevent over-tightening therebetween or excessive forceful bottoming of the cap-like member 11 or any portion thereof against the face Fa of the forestock F or the terminal end (unnumbered) of either the magazine tube M or the detent tube T. Furthermore, it is also desirable to prevent the cap-like member 11 from inadvertently or accidentally unthreading from the threaded end portion E of the magazine tube M once the two have been threaded together. The foregoing is achieved by respective locking means 21, 22 in the form of annularly arranged lands/peaks/projections and valleys/slots respectively identified by the reference numerals 25, 26, and 23, 24, respectively. In other words, the slots or valleys 23 and the lands or projections 25 of the locking means 21 define an alternating arrangement disposed in an annular pattern along an end face or surface (unnumbered) of the flange 15 while the valleys or slots 24 alternate with the projections or lands 26 of the locking means 22 in an annular fashion internally of and concentric of the locking means 21. The lands and valleys 26, 24, respectively, of the locking means 22 are formed on an inner surface (unnumbered) of the end panel 13 inboard of the circular opening 19.

As is best illustrated in FIG. 5, the respective means 21, 22 are in axial alignment with the respective detent locking systems D1, D2 and when the cap-like member 11 is axially aligned with and threaded upon the threaded end portion E of the magazine tube M of a particular shotgun S. The locking means 21 will cooperate with the detent locking system D1 while the locking means 22 will cooperate with the detent locking system D2 depending, of course, upon the particular shotgun S and the detent locking system D1, D2 thereof. In the case of the detent locking system D1, the cap-like member 11 is threaded upon the magazine threaded end portion E and eventually the resistance will increase as the detent ball Bd is forced to the left against the bias of the spring (unnumbered) which is tactilely noticeable to the person threading the cap-like member 11. Initially the "ratcheting" of the detent ball Bd along the lands and valleys 25, 23, respectively, of the locking means 21 is relatively light in resistance and increases as the spring of the detent locking system D1 progressively compresses. At a certain point it becomes apparent to the person threading the cap-like member 11 upon the threaded end portion E of the magazine tube M that further tightening is unnecessary and unthreading will be precluded by a portion of the detent ball Db being partially seated within one of the slots or valleys 23 of the locking means 21.

In a similar fashion the lands and valleys, 26, 24, respectively, of the locking means 22 will engage the geared or ratcheted detent locking system D2 of the tube T to prevent bottoming of the cap-like member 11 and prevent inadvertent removal thereof from the threaded end portion E of the magazine tube M.

The swivel means 12 is defined by a cylindrical member or post 30 having a cylindrical bore 31 formed therethrough with the axes (not shown) of the post 30 and the bore 31 being normal to each other. The post 30 includes a terminal radially outwardly directed shoulder 32 axially spaced from a radially short shoulder 33 having a tapered surface 34. The shoulders 32, 33 define therebetween a radially outwardly opening cylindrical groove 35 having an axial length corresponding generally to the thickness of the end panel 13. The relative clearances between the circular opening 19, the thickness of the end panel 13, the distance between the shoulders 32, 33 and the diameter of the groove 35 is such as to allow the swivel means 12 to rotate 360° relative to the cap-like member 11 to accommodate any particular position of the sling S1 when secured thereto by a conventional swivel pin P (FIG. 1) passing through the bore 31 of the post 30. It should be noted that since the cap-like member 11 and the swivel 12 are preferably constructed from nylon material, the swivel 12 can be assembled by simply moving the swivel 12 upwardly from the position shown in FIG. 3, passing the post 30 thereof through the opening 19 in a progressive manner during which the tapered surface or shoulder 34 will temporarily deform, as will the opening 19, until completely passing through the opening 19 at which time the shoulder 33 will rebound to the position shown in FIG. 5 maintaining the swivel 12 firmly united to the cap-like member 11, yet permitting the 360° swivelling action heretofore noted.

From the foregoing, it is readily apparent that the magazine sling attaching device 10 is of a relatively simple and straightforward construction, yet has uniform application for securing the sling S1 to any of a variety of shotguns having different detent locking systems, such as but not limited to the detent locking systems D1 and D2.

Although a preferred embodiment of the invention has been specifically illustrated and described herein, it is to be understood that minor variations may be made in the apparatus without departing from the spirit and scope of the invention, as defined in the appended claims.

I claim:

1. A magazine sling attaching device comprising a cap-like member defined by an end wall and a peripheral skirt, swivel means carried by said end wall for at least limited rotation, said swivel means including means for securing a shotgun sling thereto, said peripheral skirt including means for removably securing said cap-like member to a shotgun magazine, said first and second means for preventing inadvertent operation of said removable securing means, said first and second means include respective first and second sets of a plurality of peaks and valleys with each set being disposed in a generally annular configuration in respective first and second planes with each disposed substantially normal to an axis of rotation of said swivel means, said swivel means including a post having a longitudinal axis, a bore transverse to said longitudinal axis, said post being received in an opening of said end wall, and said post having first and second shoulder means spaced along said longitudinal axis and disposed on opposite sides of said end wall for retaining said post against displacement along its longitudinal axis while permitting rotation thereof.

* * * * *